US007140793B2

(12) United States Patent
Cook

(10) Patent No.: US 7,140,793 B2
(45) Date of Patent: Nov. 28, 2006

(54) IMAGING APPARATUS HAVING A CARRIER SUPPORT AND DRIVE ARRANGEMENT

(75) Inventor: Brian Dale Cook, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 68 days.

(21) Appl. No.: 10/871,803

(22) Filed: Jun. 18, 2004

(65) Prior Publication Data

US 2005/0281603 A1 Dec. 22, 2005

(51) Int. Cl.
*B41J 25/304* (2006.01)
*B41J 19/20* (2006.01)

(52) U.S. Cl. ..... 400/352; 400/691

(58) Field of Classification Search ..... None
See application file for complete search history.

(56) References Cited

U.S. PATENT DOCUMENTS

| | | | | |
|---|---|---|---|---|
| 4,526,486 | A | 7/1985 | Kikuchi et al. | |
| 4,687,361 | A | 8/1987 | Kikuchi et al. | |
| 4,818,129 | A | 4/1989 | Tanuma et al. | |
| 4,976,556 | A | 12/1990 | Longrod | |
| 5,368,403 | A * | 11/1994 | Broder et al. | 400/352 |
| 5,529,411 | A | 6/1996 | Nakata | |
| 5,582,070 | A | 12/1996 | Dominguez | |
| 5,586,828 | A * | 12/1996 | Nakata | 400/185 |
| 5,669,724 | A * | 9/1997 | Kato | 400/605 |
| 6,092,941 | A | 7/2000 | Imai | |
| 6,120,127 | A | 9/2000 | Inoue et al. | |
| 6,742,865 | B1 * | 6/2004 | Yusef et al. | 347/37 |
| 6,789,966 | B1 * | 9/2004 | Tanaka et al. | 400/354 |
| 2004/0145783 | A1 * | 7/2004 | Murray | 358/472 |
| 2005/0088471 | A1 * | 4/2005 | Endo | 347/16 |

FOREIGN PATENT DOCUMENTS

| | | |
|---|---|---|
| JP | 60-048368 | 3/1985 |
| JP | 04-282252 | 7/1992 |
| JP | 04-334473 | 11/1992 |
| JP | 2002254746 A * | 9/2002 |
| JP | 2003305911 A * | 10/2003 |

OTHER PUBLICATIONS

Machine translation of JP 2003-305911 to Takeuchi et al. from Japanese Patent Office website.*
Machine translation of JP 2002-254746 to Tanaka et al. from Japanese Patent Office website.*

* cited by examiner

*Primary Examiner*—Daniel J. Colilla
(74) *Attorney, Agent, or Firm*—Ronald K. Aust

(57) ABSTRACT

An imaging apparatus includes a mid-frame for supporting the sheet of print media. A unitary carrier support frame is positioned above the mid-frame. The unitary carrier support frame defines a first guide member and a second guide member, wherein a longitudinal extent of each of the first guide member and the second guide member is in a direction substantially perpendicular to the sheet feed direction. A printhead carrier is provided having a first bearing member for engaging the first guide member, and a second bearing member for engaging the second guide member.

16 Claims, 5 Drawing Sheets

IMAGING APPARATUS HAVING A CARRIER SUPPORT AND DRIVE ARRANGEMENT

BACKGROUND OF THE INVENTION

1. Field of the Invention

The present invention relates to an imaging apparatus, and, more particularly, to a carrier support and drive arrangement for an imaging apparatus.

2. Description of the Related Art

A typical inkjet printhead has a carrier frame that provides the structure on which other parts are positioned. Typically the carrier frame has a pair of end walls, between which one or more carrier guide rods are suspended. In turn, the carrier guide rods support a printhead carrier for reciprocating movement along the carrier guide rods. The printhead carrier mounts one of more printheads. A carrier drive belt is attached to the printhead carrier, with the carrier drive belt being suspended between a carrier motor drive pulley and an idler pulley. The reciprocation of the printhead carrier is achieved through the carrier motor/drive belt arrangement. A mid-frame is provided to support a sheet of print media in a print zone. An idler roller crossbar, mounting a plurality of star wheels, is mounted to a downstream end of the mid-frame.

In such an arrangement, a print gap, i.e., the vertical distance between the printheads and the top surface of the mid-frame, is typically difficult to control.

What is needed in the art is an imaging apparatus configured to provide improved control of a print gap.

SUMMARY OF THE INVENTION

The present invention provides an imaging apparatus configured to provide improved control of a print gap.

The present invention, in one form thereof, is directed to an imaging apparatus for printing on a sheet of print media in a print zone. The sheet of print media is transported in a sheet feed direction through the print zone. The imaging apparatus includes a mid-frame for supporting the sheet of print media. A unitary carrier support frame is positioned above the mid-frame. The unitary carrier support frame defines a first guide member and a second guide member, wherein a longitudinal extent of each of the first guide member and the second guide member is in a direction substantially perpendicular to the sheet feed direction. A printhead carrier is provided having a first bearing member for engaging the first guide member, and a second bearing member for engaging the second guide member.

The present invention, in another form thereof, is directed to an imaging apparatus for printing on a sheet of print media in a print zone. The sheet of print media is transported in a sheet feed direction through the print zone. The imaging apparatus includes a mid-frame for supporting the sheet of print media. A carrier support frame is positioned above the mid-frame. The carrier support frame defines a first guide member, a second guide member and a gear rack, wherein a longitudinal extent of each of the first guide member, the second guide member and the gear rack is in a direction substantially perpendicular to the sheet feed direction. A printhead carrier is provided having a first bearing member for engaging the first guide member, and a second bearing member for engaging the second guide member. A carrier motor is attached to the printhead carrier. The carrier motor is coupled to a gear that engages the gear rack of the carrier support frame.

The present invention, in still another form thereof, is directed to an imaging apparatus for printing on a sheet of print media in a print zone. The sheet of print media is transported in a sheet feed direction through the print zone. The imaging apparatus includes a mid-frame for supporting the sheet of print media. A carrier support frame is positioned above the mid-frame. The carrier support frame defines a first guide member and a second guide member, wherein a longitudinal extent of each of the first guide member and the second guide member is in a direction substantially perpendicular to the sheet feed direction. A printhead carrier is provided having a first bearing member for engaging the first guide member, and a second bearing member for engaging the second guide member. A carrier drive belt is attached to the printhead carrier. The carrier drive belt is located upstream, in relation to the sheet feed direction, to the first guide member and the second guide member. A carrier motor is attached to the carrier support frame at a location outside the print zone. The carrier motor is coupled to a pulley that engages the carrier drive belt.

An advantage of the present invention is that it provides improved control of a print gap over that of a typical ink jet print engine.

Another advantage is that a part count is reduced over that of a typical ink jet print engine, thereby producing a cost savings.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
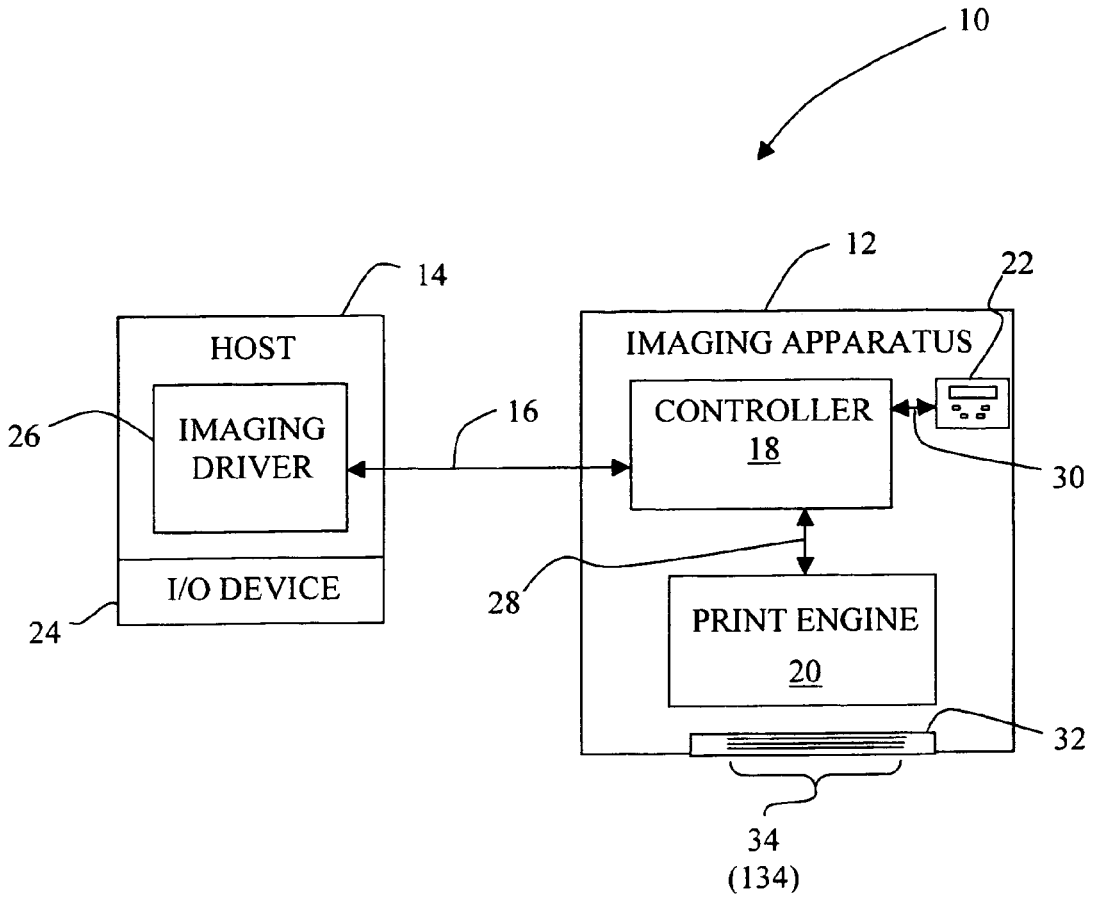
FIG. 1 is a diagrammatic representation of a system, including an imaging apparatus, employing an embodiment of the present invention.

Referring now to the drawings, and particularly to FIG. 1, there is shown a system 10 illustrating one embodiment the present invention. System 10 may include an imaging apparatus 12 and a host 14, with imaging apparatus 12 communicating with host 14 via a communications link 16. Communications link 16 may be established by a direct cable connection, wireless connection or by a network connection such as for example an Ethernet local area network (LAN). Imaging apparatus 12 may include, for example, a controller 18, a print engine 20, and a user interface 22.

Alternatively, imaging apparatus 12 may be a standalone unit that is not communicatively linked to a host, such as host 14. For example, imaging apparatus 12 may take the form of a multifunction machine that includes standalone copying and facsimile capabilities, in addition to optionally serving as a printer when attached to a host, such as host 14.

In embodiments of the invention that include host 14, host 14 may be, for example, a personal computer including an input/output (I/O) device 24, such as keyboard and display monitor. Host 14 also may include a processor, input/output (I/O) interfaces, memory, such as RAM, ROM, NVRAM, and a mass data storage device, such as a hard drive, CD-ROM and/or DVD units. During operation, host 14 may include in its memory a software program including program instructions that function as an imaging driver 26, e.g., printer driver software, for imaging apparatus 12. Imaging driver 26 is in communication with controller 18 of imaging apparatus 12 via communications link 16. Imaging driver 26 facilitates communication between imaging apparatus 12 and host 14, and may provide formatted print data, as determined by a selected print mode, to imaging apparatus 12, and more particularly, to print engine 20.

Alternatively, however, all or a portion of imaging driver 26 may be located in controller 18 of imaging apparatus 12. For example, where imaging apparatus 12 is a multifunction machine having standalone capabilities, controller 18 of imaging apparatus 12 may include an imaging driver configured to support a copying function, and/or a fax-print function, and may be further configured to support a printer function. In this embodiment, the imaging driver facilitates communication of formatted print data to print engine 20.

Controller 18 of imaging apparatus 12 may include a processor unit and associated memory, and may be formed as an Application Specific Integrated Circuit (ASIC). Controller 18 communicates with print engine 20 via a communications link 28. Controller 18 communicates with user interface 22 via a communications link 30. Each of communications links 28 and 30 may be established, for example, by using one of a standard electrical cabling or bus structure, or by a wireless connection. User interface 22 may include buttons for receiving user input, such as for example, power on, or print media tray selection. User interface 22 may also include a display screen for displaying information relating to imaging apparatus 12, such as for example, print job status information.

Figure 2:
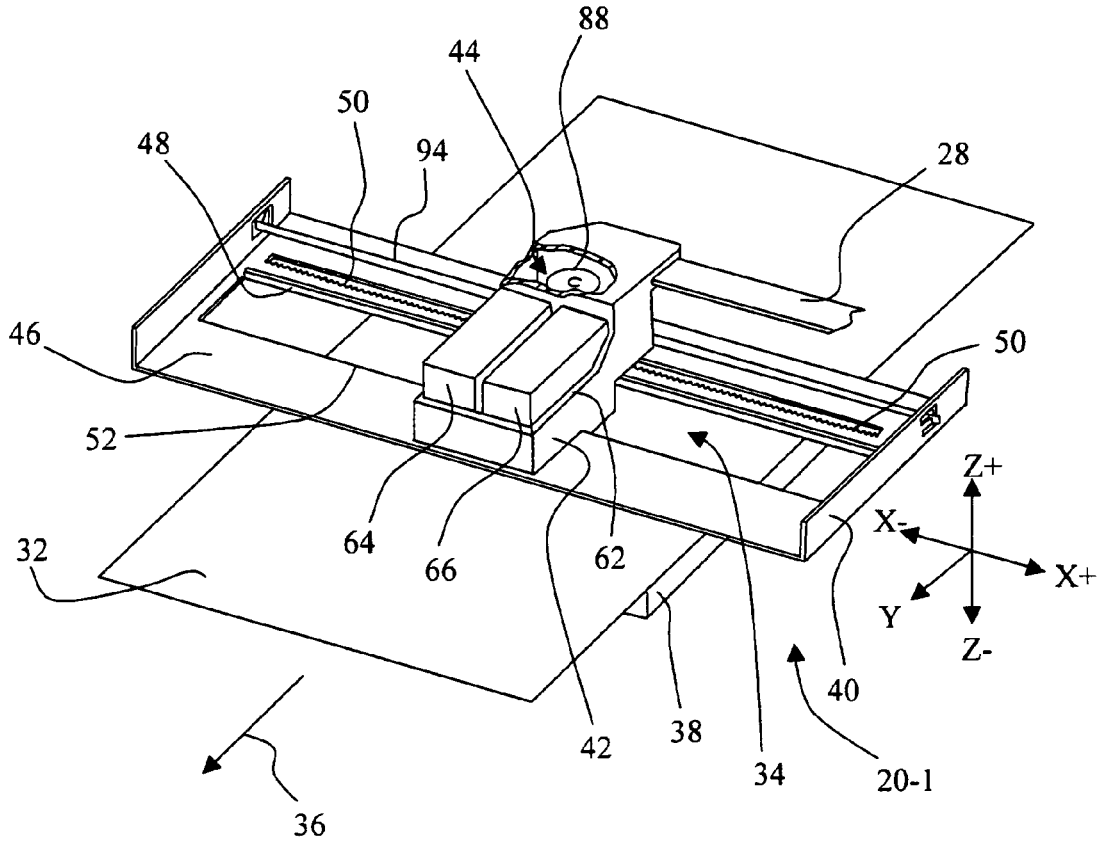
FIG. 2 is a perspective view of one embodiment of a print engine that may be used in the imaging apparatus of FIG. 1.
Figure 3:
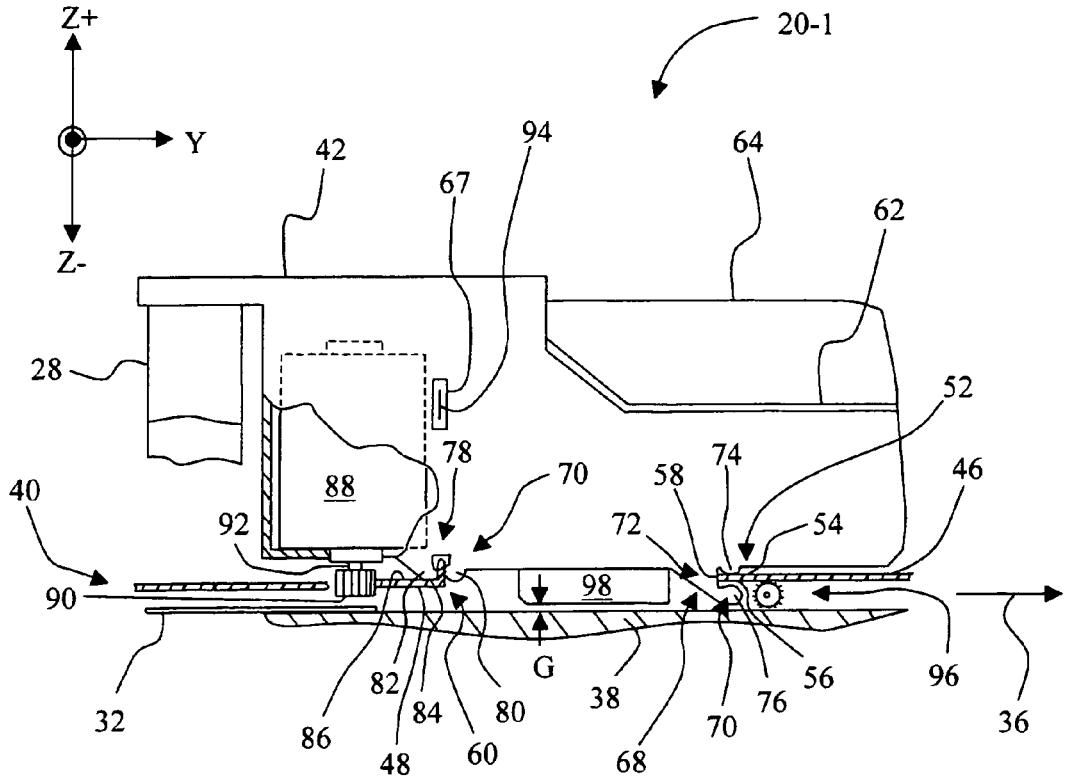
FIG. 3 is a side view of the print engine of FIG. 2.
Figure 4:
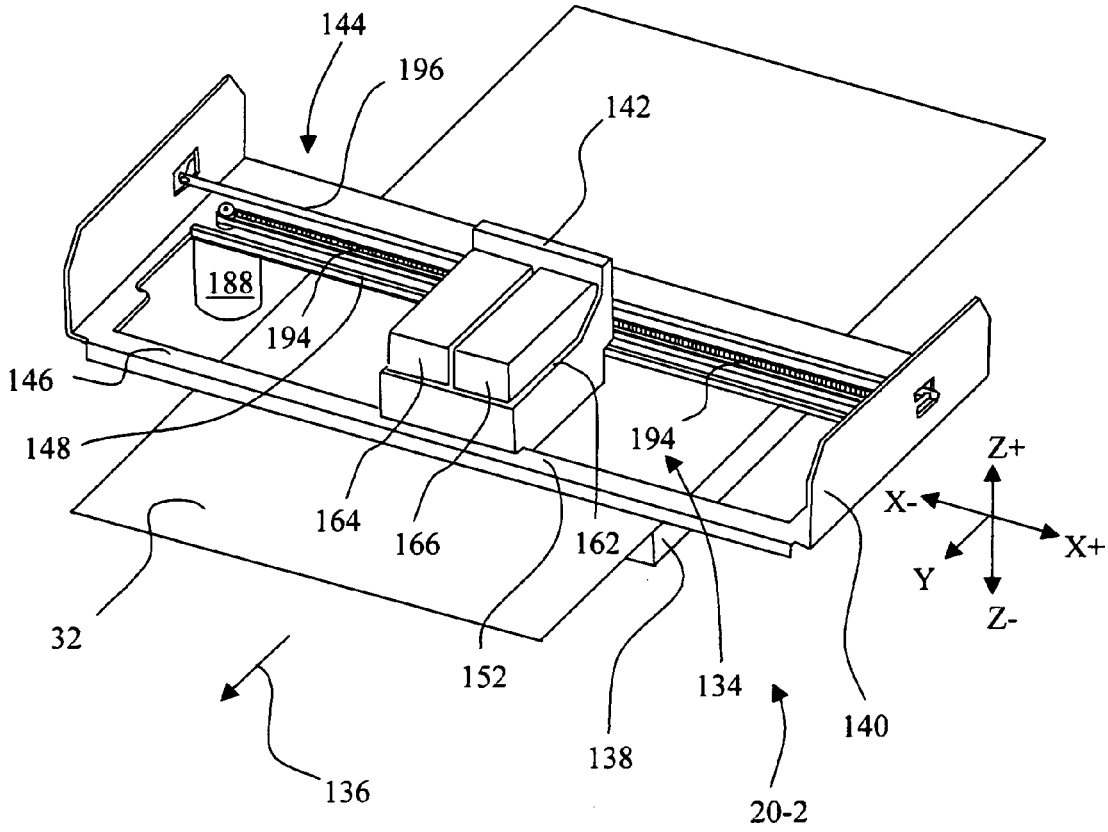
FIG. 4 is a perspective view of another embodiment of a print engine that may be used in the imaging apparatus of FIG. 1.
Figure 5:
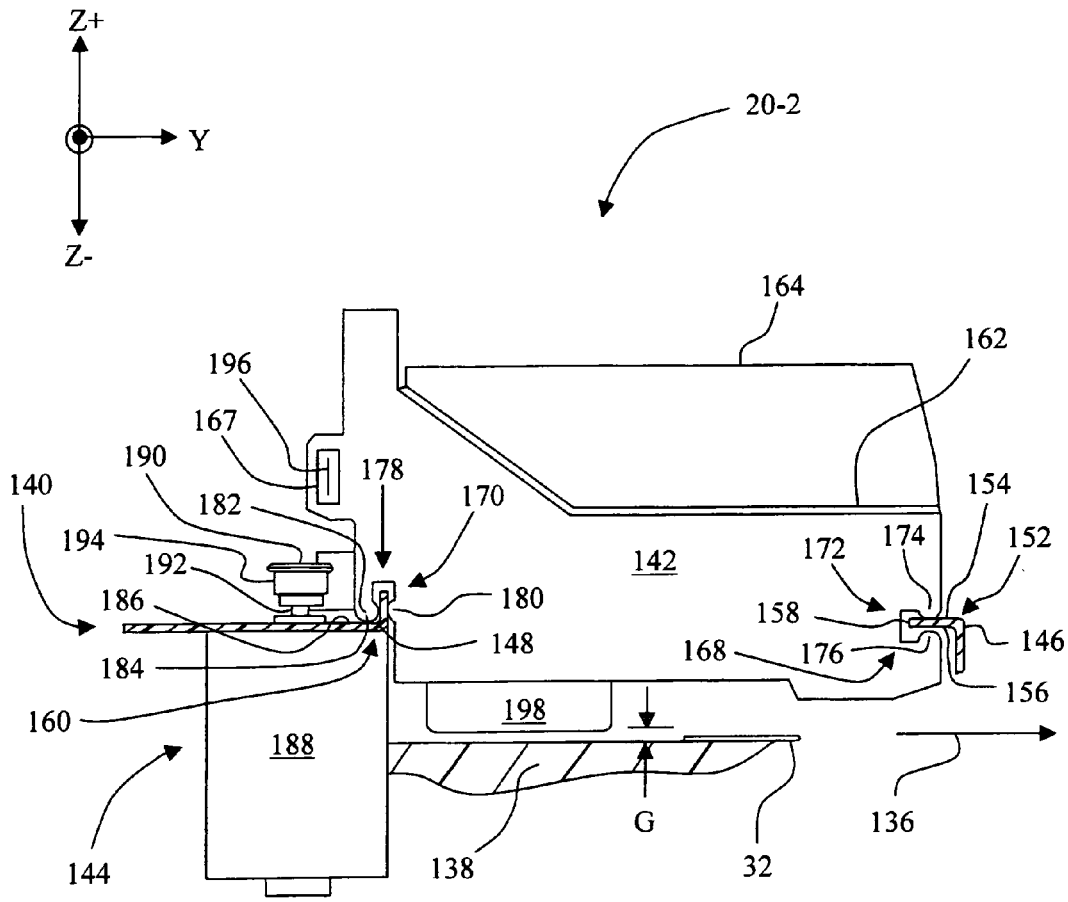
FIG. 5 is a side view of the print engine of FIG. 4.

In accordance with the present invention, print engine 20 has a reciprocating carrier, such as for example, a printhead carrier for carrying an ink jet printhead cartridge, as in the case where print engine 20 is an ink jet print engine. FIGS. 2 and 3 are directed to one exemplary embodiment of the present invention in the form of an ink jet print engine 20-1. FIGS. 4 and 5 are directed to another exemplary embodiment of the present invention in the form of an ink jet print engine 20-2.

Referring now to the embodiment of FIGS. 2 and 3, imaging apparatus 12 may include ink jet print engine 20-1, which is configured for printing on a sheet of print media 32 in a print zone 34. The sheet of print media 32 is transported by sheet feed rollers (not shown) in a sheet feed direction 36, i.e., direction Y, through print zone 34.

Ink jet print engine 20-1 includes a mid-frame 38, a carrier support frame 40, a printhead carrier 42, and a carrier drive system 44. Mid-frame 38 provides support for the sheet of print media 32 in print zone 34 in a region below, i.e., in direction Z−, printhead carrier 42. Carrier support frame 40 is positioned above mid-frame 38, i.e., in direction Z+. Accordingly, mid-frame 38 may be attached to a bottom surface of carrier support frame 40.

Carrier support frame 40, which may be formed as a unitary structure, defines a first guide member 46, a second guide member 48 and a gear rack 50, wherein a longitudinal extent, i.e., in directions X−, X+, of each of first guide member 46, second guide member 48 and gear rack 50 is in a direction substantially perpendicular to sheet feed direction 36, also referred to as direction Y. Gear rack 50 is positioned upstream, in relation to sheet feed direction 36, to first guide member 46 and second guide member 48. First guide member 46 includes a horizontally extending portion 52 defining an upper guide surface 54, a lower guide surface 56 and an edge surface 58 that vertically extends between upper guide surface 54 and a lower guide surface 56. Second guide member 48 may include a vertically extending tab 60.

Printhead carrier 42 includes an ink jet cartridge receptacle 62 for receiving and mounting at least one ink jet cartridge, e.g., monochrome ink jet cartridge 64 and color ink jet cartridge 66. Printhead carrier 42 includes an opening 67 that passes through printhead carrier 42 in a direction substantially perpendicular, i.e., directions X−, X+, to sheet feed direction 36. Printhead carrier 42 also includes a first bearing member 68 for engaging first guide member 46, and a second bearing member 70 for engaging second guide member 48.

First bearing member 68 defines a horizontal slot 72 defining an upper bearing pad 74 and a lower bearing pad 76. Horizontally extending portion 52 of first guide member 46 is received between upper bearing pad 74 and lower bearing pad 76. Second bearing member 70 defines a vertical slot 78 defining a first side bearing pad 80, a second side bearing pad 82 and a bottom pad 84. Vertically extending tab 60 of second guide member 48 is received between first side bearing pad 80 and second side bearing pad 82, with bottom pad 84 engaging a surface 86 of carrier support frame 40.

Carrier drive system 44 includes a carrier motor 88, e.g., a direct current (DC) motor, which is attached to printhead carrier 42. Carrier motor 88 is coupled to a pinion gear 90 via a motor shaft 92. Carrier motor 88 is positioned such that pinion gear 90 engages gear rack 50 of carrier support frame 40. Accordingly, when carrier motor 88 is electrically actuated, the rotation of pinion gear 90 is translated by rack gear 50 into a linear motion of printhead carrier 42 in one of directions X−, X+, depending on the direction of rotation of pinion gear 90.

Thus, with the configuration of imaging apparatus 12 including ink jet print engine 20-1, there is provided improved control of a print gap (G), i.e., the vertical distance between the printheads 98 carried by printhead carrier 42 and the top surface of mid-frame 38, and in turn the sheet of print media 32, over that of a typical ink jet print engine.

In the arrangement of FIGS. 2 and 3, an encoder strip 94 extends through opening 67. Opening 67 is positioned between carrier motor 88 and ink jet cartridge receptacle 62. A reader (not shown) attached to printhead carrier 42 in the vicinity of encoder strip 94 relays information relating to the position of printhead carrier 42 to controller 18 via communications link 28.

As further shown in FIG. 2, a plurality of star wheels 96 may be mounted to carrier support frame 40 at a location downstream, in relation to the sheet feed direction 36, to first guide member 46 and second guide member 48. The plurality of star wheels 96 engage an upper side of the sheet of print media 32, with the bottom side of the sheet of print media 32 being drivingly engaged by a driven exit roller (not shown).

Referring now to the embodiment of FIGS. 4 and 5, imaging apparatus 12 may include ink jet print engine 20-2, which is configured for printing on a sheet of print media 32 in a print zone 134. The sheet of print media 32 is transported by sheet feed rollers (not shown) in a sheet feed direction 136, i.e., direction Y, through print zone 134.

Ink jet print engine 20-2 includes a mid-frame 138, a carrier support frame 140, a printhead carrier 142, and a carrier drive system 144. Mid-frame 138 provides support for the sheet of print media 32 in print zone 134 in a region below printhead carrier 142, i.e., in direction Z−. Carrier support frame 140 is positioned above mid-frame 138, i.e., in direction Z+. Accordingly, mid-frame 138 may be attached to a bottom surface of carrier support frame 140.

Carrier support frame 140, which may be formed as a unitary structure, defines a first guide member 146 and a second guide member 148, wherein a longitudinal extent, i.e., in directions X−, X+, of each of first guide member 146 and second guide member 148 is in a direction substantially perpendicular to sheet feed direction 136, also referred to as direction Y. First guide member 146 includes a horizontally extending portion 152 defining an upper guide surface 154, a lower guide surface 156 and an edge surface 158 that vertically extends between upper guide surface 154 and a lower guide surface 156. Second guide member 148 may include a vertically extending tab 160.

Printhead carrier 142 includes an ink jet cartridge receptacle 162 for receiving and mounting at least one ink jet cartridge, e.g., monochrome ink jet cartridge 164 and color ink jet cartridge 166. Printhead carrier 142 includes an opening 167 that passes through printhead carrier 142 in a direction substantially perpendicular, i.e., directions X−, X+, to sheet feed direction 136. Printhead carrier 142 also includes a first bearing member 168 for engaging first guide member 146, and a second bearing member 170 for engaging second guide member 148.

First bearing member 168 defines a horizontal slot 172 defining an upper bearing pad 174 and a lower bearing pad 176. Horizontally extending portion 152 of first guide member 146 is received between upper bearing pad 174 and lower bearing pad 176. Second bearing member 170 defines a vertical slot 178 defining a first side bearing pad 180, a second side bearing pad 182 and a bottom pad 184. Vertically extending tab 160 of second guide member 148 is received between first side bearing pad 180 and second side bearing pad 182, with bottom pad 184 engaging a surface 186 of carrier support frame 140.

Carrier drive system 144 includes a carrier motor 188, e.g., a direct current (DC) motor, which is attached to carrier support frame 140 at a location outside print zone 134. Carrier motor 188 is coupled to a pulley 190 via a motor shaft 192. Carrier motor 188 is located upstream, in relation to sheet feed direction 136, to first guide member 146 and second guide member 148, and is positioned in a plane of mid-frame 138. Carrier drive system 144 further includes a carrier drive belt 194. Carrier drive belt 194 is attached to printhead carrier 142. Carrier drive belt 194 is located upstream, in relation to sheet feed direction 136, to first guide member 146 and second guide member 148. Carrier drive belt 194 is engaged by pulley 190. Accordingly, when carrier motor 188 is electrically actuated, the rotation of pulley 190 translates the motion of carrier drive belt 194 into a linear motion of printhead carrier 142 in one of directions X−, X+, depending on the direction of rotation of pulley 190.

In the arrangement of FIGS. 4 and 5, an encoder strip 196 extends through opening 167. Opening 167 is positioned above carrier drive belt 194, such that encoder strip 196 is also positioned above carrier drive belt 194. A reader (not shown) attached to printhead carrier 142 in the vicinity of encoder strip 196 relays information relating to the position of printhead carrier 142 to controller 18 via communications link 28.

Thus, with the configuration of imaging apparatus 12 including ink jet print engine 20-2, there is provided improved control of a print gap (G), i.e., the vertical distance between the printheads 198 carried by printhead carrier 142 and the top surface of mid-frame 138, and in turn the sheet of print media 32, over that of a typical ink jet print engine.

While this invention has been described with respect to embodiments of the invention, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus for printing on a sheet of print media in a print zone, said sheet of print media being transported in a sheet feed direction through said print zone, comprising:

a mid-frame for supporting said sheet of print media in said print zone;

a unitary carrier support frame positioned above said mid-frame, said unitary carrier support frame defining a first guide member and a second guide member, wherein a longitudinal extent of each of said first guide member and said second guide member is in a direction substantially perpendicular to said sheet feed direction;

a printhead carrier having a first bearing member for engaging said first guide member, and a second bearing member for engaging said second guide member;

a gear rack, wherein a longitudinal extent of said gear rack is in said direction substantially perpendicular to said sheet feed direction; and a carrier motor attached to said printhead carrier, said carrier motor being coupled to a gear that engages said gear rack of said unitary carrier support frame, wherein said gear rack is positioned upstream, in relation to said sheet feed direction, to said first guide member and said second guide member.

2. An imaging apparatus for printing on a sheet of print media in a print zone, said sheet of print media being transported in a sheet feed direction through said print zone, comprising:

a mid-frame for supporting said sheet of print media;

a unitary carrier support frame positioned above said mid-frame, said unitary carrier support frame defining a first guide member and a second guide member, wherein a longitudinal extent of each of said first guide member and said second guide member is in a direction substantially perpendicular to said sheet feed direction;

a printhead carrier having a first bearing member for engaging said first guide member, and a second bearing member for engaging said second guide member;

a gear rack, wherein a longitudinal extent of said gear rack is in said direction substantially perpendicular to said sheet feed direction; and a carrier motor attached to said printhead carrier, said carrier motor being coupled to a gear that engages said gear rack of said unitary carrier support frame, said printhead carrier defining an ink jet cartridge receptacle and an opening passing through said printhead carrier in said direction substantially perpendicular to said sheet feed direction, said opening being positioned between said carrier motor and said ink jet cartridge receptacle, said imaging apparatus further comprising an encoder strip extending though said opening.

3. An imaging apparatus for printing on a sheet of print media in a print zone, said sheet of print media being transported in a sheet feed direction through said print zone, comprising:

a mid-frame for supporting said sheet of print media in said print zone;

a unitary carrier support frame positioned above said mid-frame, said unitary carrier support frame defining a first guide member and a second guide member, wherein a longitudinal extent of each of said first guide member and said second guide member is in a direction substantially perpendicular to said sheet feed direction;

a printhead carrier having a first bearing member for engaging said first guide member, and a second bearing member for engaging said second guide member;

a carrier drive belt attached to said printhead carrier, said carrier drive belt being located upstream, in relation to said sheet feed direction, to said first guide member and said second guide member; and a carrier motor attached to said unitary carrier support frame at a location outside said print zone, said carrier motor being coupled to a pulley that engages said carrier drive belt.

4. The imaging apparatus of claim 3, wherein said carrier motor is positioned upstream, in relation to said sheet feed direction, to said first guide member and said second guide member, and positioned in a plane of said mid-frame.

5. An imaging apparatus for printing on a sheet of print media in a print zone, said sheet of print media being transported in a sheet feed direction through said print zone, comprising:

a mid-frame for supporting said sheet of print media in said print zone;

a unitary carrier support frame positioned above said mid-frame, said unitary carrier support frame defining a first guide member and a second guide member, wherein a longitudinal extent of each of said first guide member and said second guide member is in a direction substantially perpendicular to said sheet feed direction, wherein said second guide member includes a vertically extending tab; and a printhead carrier having a first bearing member for engaging said first guide member, and a second bearing member for engaging said second guide member, said second bearing member defining a vertical slot defining a first side bearing pad, a second side bearing pad and a bottom pad, said vertically extending tab of said second guide member being received between said first side bearing pad and said second side bearing pad, said bottom pad engaging a surface of said unitary carrier support frame.

6. An imaging apparatus for printing on a sheet of print media in a print zone, said sheet of print media being transported in a sheet feed direction through said print zone, comprising:

a mid-frame for supporting said sheet of print media in said print zone;

a carrier support frame positioned above said mid-frame, said carrier support frame defining a first guide member, a second guide member and a gear rack, wherein a longitudinal extent of each of said first guide member, said second guide member and said gear rack is in a direction substantially perpendicular to said sheet feed direction;

a printhead carrier having a first bearing member for engaging said first guide member, and a second bearing member for engaging said second guide member; and a carrier motor attached to said printhead carrier, said carrier motor being coupled to a gear that engages said gear rack of said carrier support frame, wherein said gear rack is positioned upstream, in relation to said sheet feed direction, to said first guide member and said second guide member.

7. An imaging apparatus for printing on a sheet of print media in a print zone, said sheet of print media being transported in a sheet feed direction through said print zone, comprising:

a mid-frame for supporting said sheet of print media;

a carrier support frame positioned above said mid-frame, said carrier support frame defining a first guide member, a second guide member and a gear rack, wherein a longitudinal extent of each of said first guide member, said second guide member and said gear rack is in a direction substantially perpendicular to said sheet feed direction;

a printhead carrier having a first bearing member for engaging said first guide member, and a second bearing member for engaging said second guide member; and a carrier motor attached to said printhead carrier, said carrier motor being coupled to a gear that engages said gear rack of said carrier support frame, wherein said gear rack is positioned upstream, in relation to said sheet feed direction, to said first guide member and said second guide member, and said printhead carrier defining an ink jet cartridge receptacle and an opening passing through said printhead carrier in said direction substantially perpendicular to said sheet feed direction, said opening being positioned between said carrier motor and said ink jet cartridge receptacle, said imaging apparatus further comprising an encoder strip extending through said opening.

8. An imaging apparatus for printing on a sheet of print media in a print zone, said sheet of print media being transported in a sheet feed direction through said print zone, comprising:

a mid-frame for supporting said sheet of print media in said print zone;

a carrier support frame positioned above said mid-frame, said carrier support frame defining a first guide member, a second guide member and a gear rack, wherein a longitudinal extent of each of said first guide member, said second guide member and said gear rack is in a direction substantially perpendicular to said sheet feed direction, wherein said second guide member includes a vertically extending tab;

a printhead carrier having a first bearing member for engaging said first guide member, and a second bearing member for engaging said second guide member; and a carrier motor attached to said printhead carrier, said carrier motor being coupled to a gear that engages said gear rack of said carrier support frame, said second bearing member defining a vertical slot defining a first side bearing pad, a second side bearing pad and a bottom pad, said vertically extending tab of said second guide member being received between said first side bearing pad and said second side bearing pad, said bottom pad engaging a surface of said carrier support frame.

9. An imaging apparatus for printing on a sheet of print media in a print zone, said sheet of print media being transported in a sheet feed direction through said print zone, comprising:

a mid-frame for supporting said sheet of print media in said print zone;

a carrier support frame positioned above said mid-frame, said carrier support frame defining a first guide member and a second guide member, wherein a longitudinal extent of each of said first guide member and said second guide member is in a direction substantially perpendicular to said sheet feed direction;

a printhead carrier having a first bearing member for engaging said first guide member, and a second bearing member for engaging said second guide member;

a carrier drive belt attached to said printhead carrier, said carrier drive belt being located upstream, in relation to said sheet feed direction, to said first guide member and said second guide member; and a carrier motor attached to said carrier support frame at a location outside said print zone, said carrier motor being coupled to a pulley that engages said carrier drive belt.

10. The imaging apparatus of claim 9, wherein said carrier motor is positioned upstream, in relation to said sheet feed direction, to said first guide member and said second guide member, and positioned in a plane of said mid-frame.

11. The imaging apparatus of claim 10, said printhead carrier defining an opening, said imaging apparatus further comprising an encoder strip extending through said opening, said encoder strip being positioned above said carrier drive belt.

12. The imaging apparatus of claim 9, wherein said first guide member includes a horizontally extending portion defining an upper guide surface, a lower guide surface and an edge surface vertically extending between said upper guide surface and said lower guide surface.

13. The imaging apparatus of claim 12, said first bearing member defining a horizontal slot defining an upper bearing pad and a lower bearing pad, said horizontally extending portion of said first guide member being received between said upper bearing pad and said lower bearing pad.

14. The imaging apparatus of claim 9, wherein said second guide member includes a vertically extending tab.

15. The imaging apparatus of claim 14, said second bearing member defining a vertical slot defining a first side bearing pad, a second side bearing pad and a bottom pad, said vertically extending tab of said second guide member being received between said first side bearing pad and said second side bearing pad, said bottom pad engaging a surface of said carrier support frame.

16. The imaging apparatus of claim 9, wherein said carrier support frame is a unitary structure.

* * * * *